United States Patent [19]

Depianta

[11] Patent Number: 5,042,802

[45] Date of Patent: Aug. 27, 1991

[54] BATTING PRACTICE APPARATUS

[76] Inventor: Richard P. Depianta, 85 Ten Acre Rd., Middletown, Conn. 06457

[21] Appl. No.: 578,681

[22] Filed: Sep. 7, 1990

[51] Int. Cl.[5] ..... A63B 69/00

[52] U.S. Cl. ..... 273/26 D; 273/29 A

[58] Field of Search ..... 273/26 R, 29 A, 26 D, 273/30

[56] References Cited

U.S. PATENT DOCUMENTS

| | | | |
|---|---|---|---|
| 1,777,976 | 10/1930 | Lacoste | 273/26 D |
| 2,955,824 | 10/1960 | Chanko | 273/26 D |
| 3,677,544 | 7/1972 | Meyers et al. | 273/26 D |
| 3,779,227 | 12/1973 | Scott | 273/26 D |
| 4,538,810 | 9/1985 | Brophy | 273/26 D |
| 4,676,504 | 6/1987 | Ponza | 273/26 D |
| 4,830,372 | 5/1989 | Outlaw | 273/26 R |

*Primary Examiner*—Theatrice Brown

*Attorney, Agent, or Firm*—Leon Gilden

[57] ABSTRACT

An apparatus is set forth including a support platform mounting a positioning tube telescopingly receiving an adjusting tube therein, wherein the adjusting tube mounts a joint member to secure a delivery tube at an upper end thereof. The delivery tube includes an outwardly oriented lowermost tube for delivery of a baseball to an associated batter. The invention further provides structure to include an arcuate directing tube and a funnel at an upper end of the delivery tube, with a selectively mounted lower arcuate directed tube mounted to a lower end of the delivery tube to permit modification and variation of a baseball being directed through the delivery tube. The delivery tube may be further pivotally mounted at its lower end, including an adjustment leg at a rear end for rear end angularity of the delivery tube.

6 Claims, 5 Drawing Sheets

PRIOR ART

BATTING PRACTICE APPARATUS

BACKGROUND OF THE INVENTION

1. Field of the Invention

The field of invention relates to batting practice apparatus, and more particularly pertains to a new and improved batting practice apparatus wherein the same provides an organization to permit variation of baseball delivery speed and angularity.

2. Description of the Prior Art

Baseball batting practice apparatus has been developed in the prior art of various construction. Heretofore, however, such construction is yet to provide the flexibility and adaptability of the organization as set forth by the instant invention in delivering baseball pitches of varying angularity and speed to an associated batter. For example. U.S. Pat. No. 4,538,810 provides a delivery chute Permitting delivery of baseballs from a plurality of magazine sources mounted at an upward end of the chute.

Desiletes U.S. Pat. No. 3,999,753 sets forth a tennis ball delivery formulation wherein a tennis ball is delivered from a chute to a sock-like member at a lower end thereof, wherein the sock-like member releases the tennis ball upon impact by a tennis racket.

Ponza U.S. Pat. No. 4,676,504 sets forth a ball delivery system utilizing arcuate chute to permit selective release of a ball member at a lower end thereof.

Chanko U.S. Pat. No. 2,955,824 sets forth a further example of a batting practice device that selectively releases baseballs from a lower end of the tube onto a support bracket awaiting impact by an associated bat member.

As such, it may be appreciated that there continues to be a need for a new and improved batting practice apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of batting practice apparatus now present in the prior art, the present invention provides a batting practice apparatus wherein the same permits selective delivery and angular positioning and speed of a baseball directed at an associated batter. As such, the general purpose of the present invention, which will be described subsequently in greater detail, is to provide a new and improved batting practice apparatus which has all the advantages of the prior art batting practice apparatus and none of the disadvantages.

To attain this, the present invention provides an apparatus setting forth a support platform mounting a positioning tube telescopingly receiving an adjusting tube therein, wherein the adjusting tube mounts a joint member to secure a delivery tube at an upper end thereof. The delivery tube includes an outwardly oriented lowermost tube for delivery of a baseball to an associated batter. The invention further provides structure to include an arcuate directing tube and a funnel at an upper end of the delivery tube, with a selectively mounted lower arcuate directed tube mounted to a lower end of the delivery tube to permit modification and variation of a baseball being directed through the delivery tube. The delivery tube may be further pivotally mounted at its lower end, including an adjustment leg at a rear end for rear end angularity of the delivery tube.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved batting practice apparatus which has all the advantages of the prior art batting practice apparatus and none of the disadvantages.

It is another object of the present invention to provide a new and improved batting practice apparatus which may be easily and efficiently manufactured and marketed.

It is a further object of the present invention to provide a new and improved batting practice apparatus which is of a durable and reliable construction.

An even further object of the present invention is to provide a new and improved batting practice apparatus which is susceptible of a low cost of manufacture with regard to both materials and labor, and which accordingly is then susceptible of low prices of sale to the consuming public, thereby making such batting practice apparatus economically available to the buying public.

Still yet another object of the present invention is to provide a new and improved batting practice apparatus which provides in the apparatuses and methods of the prior art some of the advantages thereof, while simultaneously overcoming some of the disadvantages normally associated therewith.

Still another object of the present invention is to provide a new and improved batting practice apparatus wherein the same provides a structurally permitting modification of speed and angular delivery of a baseball to an associated batter.

These together with other objects of the invention, along with the various features of novelty which characterize the invention, are pointed out with particularity in the claims annexed to and forming a part of this disclosure. For a better understanding of the invention.

its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
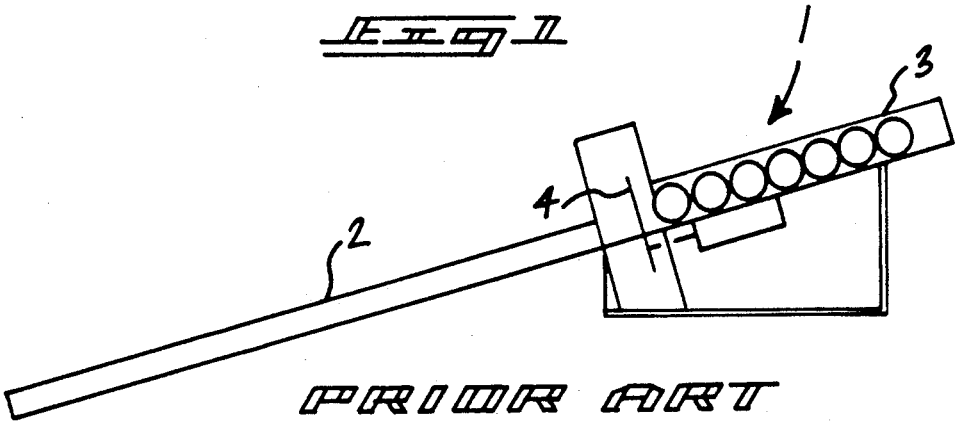
FIG. 1 is an orthographic side view, taken in elevation, of a prior art batting practice apparatus.

With reference now to the drawings, and in particular to FIGS. 1 to 9 thereof, a new and improved batting practice apparatus embodying the principles and concepts of the present invention and generally designated by the reference numeral 10 will be described.

Figure 2:
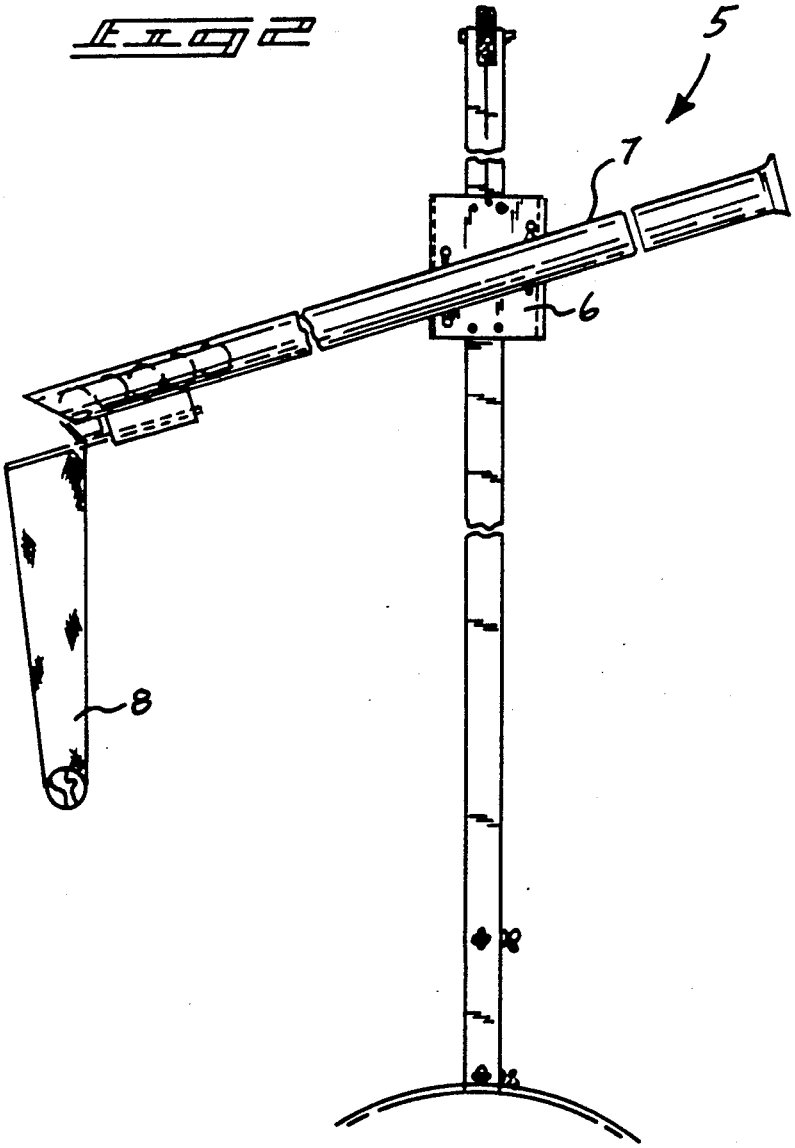
PRIOR ART FIG 2
FIG. 2 is an orthographic side view, taken in elevation, of a ball delivery apparatus as a further example of a prior art organization.

FIG. 1 illustrates a prior art batting practice apparatus 1, as exemplified in U.S. Pat. No. 4,538,810, with a lower chute 2 delivering baseball members from an upper magazine 3, wherein the organization 1 utilizes a rotary disk to release baseball members from the magazine. FIG. 2 illustrates a further prior art ball release mechanism, as set forth in U.S. Pat. No. 3,999,753, wherein the delivery tube 7 mounted upon the support 6 permits the organization 5 to deliver tennis balls to a downwardly oriented sock 8 that releases an associated ball upon impact by a tennis racket and the like.

Figure 3:
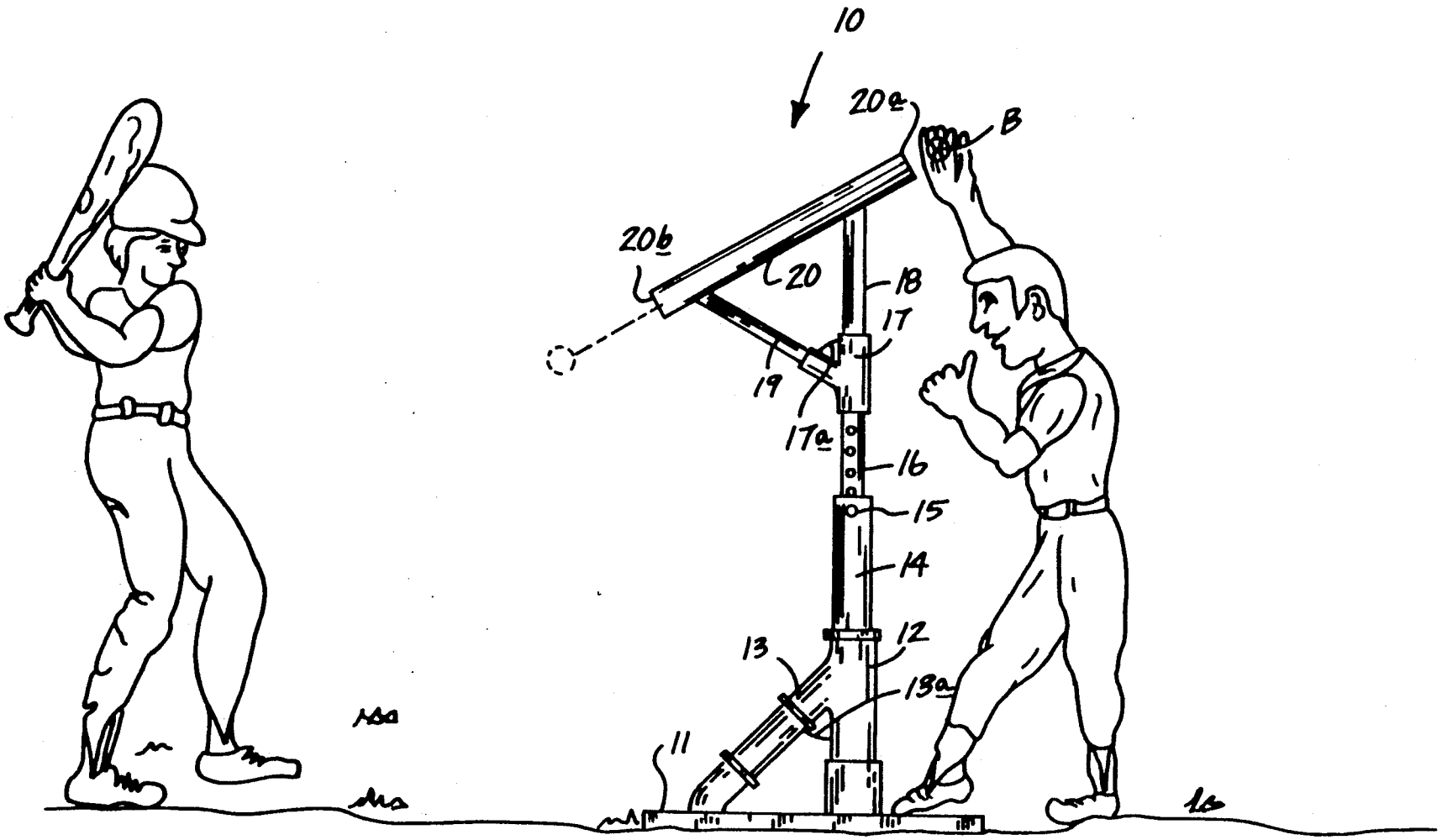
FIG. 3 is an orthographic side view, taken in elevation, of the instant invention.

More specifically, the batting practice apparatus 10 of the instant invention essentially comprises a support platform 11 including a first platform leg 12 orthogonally mounted to an upper terminal end of the support platform, with a second platform leg 13 mounted at a first acute included angle between an upper terminal end of the first platform leg 12 and the second platform leg 13. Positioning tube 14 is vertically and longitudinally aligned with the first platform leg 12 and includes a removable pin 15 to telescopingly receive an apertured adjusting tube 16, including a series of equally spaced apertures therethrough to permit vertical adjustment of the apertured tube relative to the positioning tube 14. A joint member 17 is formed at an upper terminal end of the apertured adjusting tube 16 and includes a first upper leg 18 longitudinally aligned with the apertured adjusting tube 16 and a second upper leg 19 defining a second acute included angle between the first leg 18 and the second upper leg 19. A delivery tube 20 is triangulated and mounted to upper terminal ends of the first and second upper legs 18 and 19 respectively, wherein the delivery tube 20 includes a delivery tube upper end **20*a* and a delivery tube lower end 20*b* to permit directing of a baseball "B" through the delivery tube to an associated batter, as illustrated in FIG. 3** for example.

Figure 4:
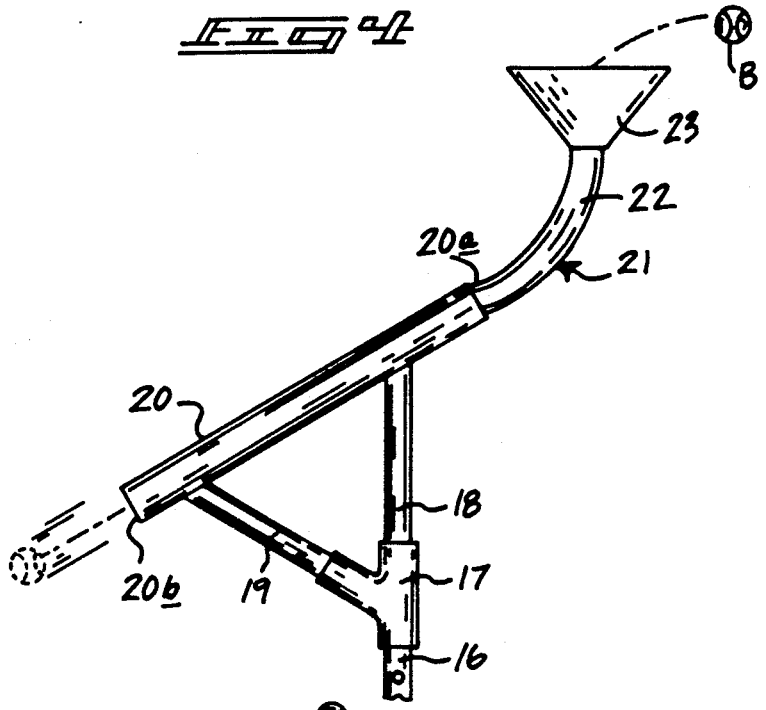
FIG. 4 is an orthographic side view, taken in elevation, of the invention utilizing an upper attachment.
Figure 5:
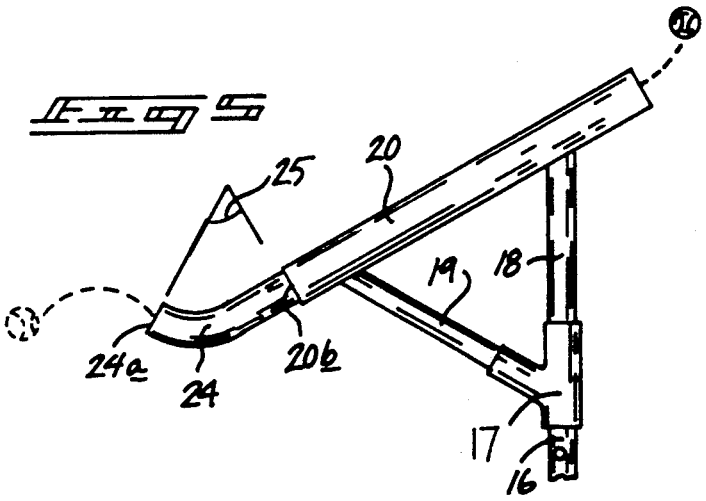
FIG. 5 is an orthographic side view, taken in elevation, of the instant invention, utilizing a lower attachment.
Figure 6:
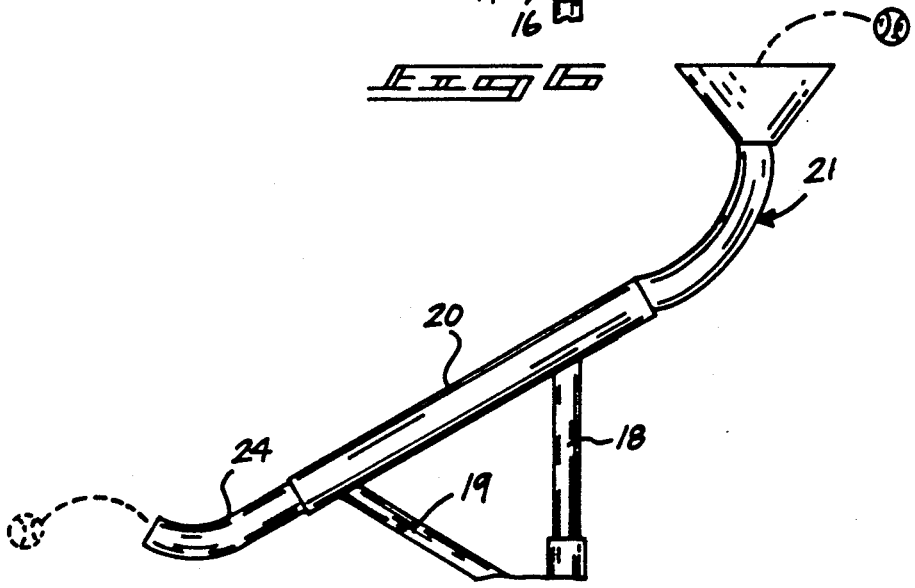
FIG. 6 is an orthographic side view, taken in elevation, of the instant invention utilizing the upper and lower attachments in combination.

FIG. 4 illustrates the use of a "fast pitch" assembly 21 that is defined by an upper arcuate directing tube 22 received within the delivery tube upper end **20*a*, with the upper arcuate directing tube 22 mounting a funnel 23 at an upper end of the upper directing tube 22 to add momentum to an associated baseball "B" directed through the delivery tube 20. FIG. 5 illustrates the use of a lower arcuate directing tube 24 mounted within the lower terminal end of the delivery tube 20 that includes a forward directing tube end 24*a* defining a third acute included angle 25 defined by the forward directing tube end 24*a* and the lower terminal end of the delivery tube 20. The lower arcuate directing tube 24 provides a relatively "slow pitch" to be directed to an associated batter. FIG. 6 illustrates the combination of the fast pitch assembly 21 and the lower arcuate directing tube 24** to provide a velocity to the baseball "B" of a medium speed and of a somewhat upwardly directed orientation relative to an associated batter to familiarize a batter with various types of pitches to be encountered.

Figure 7:
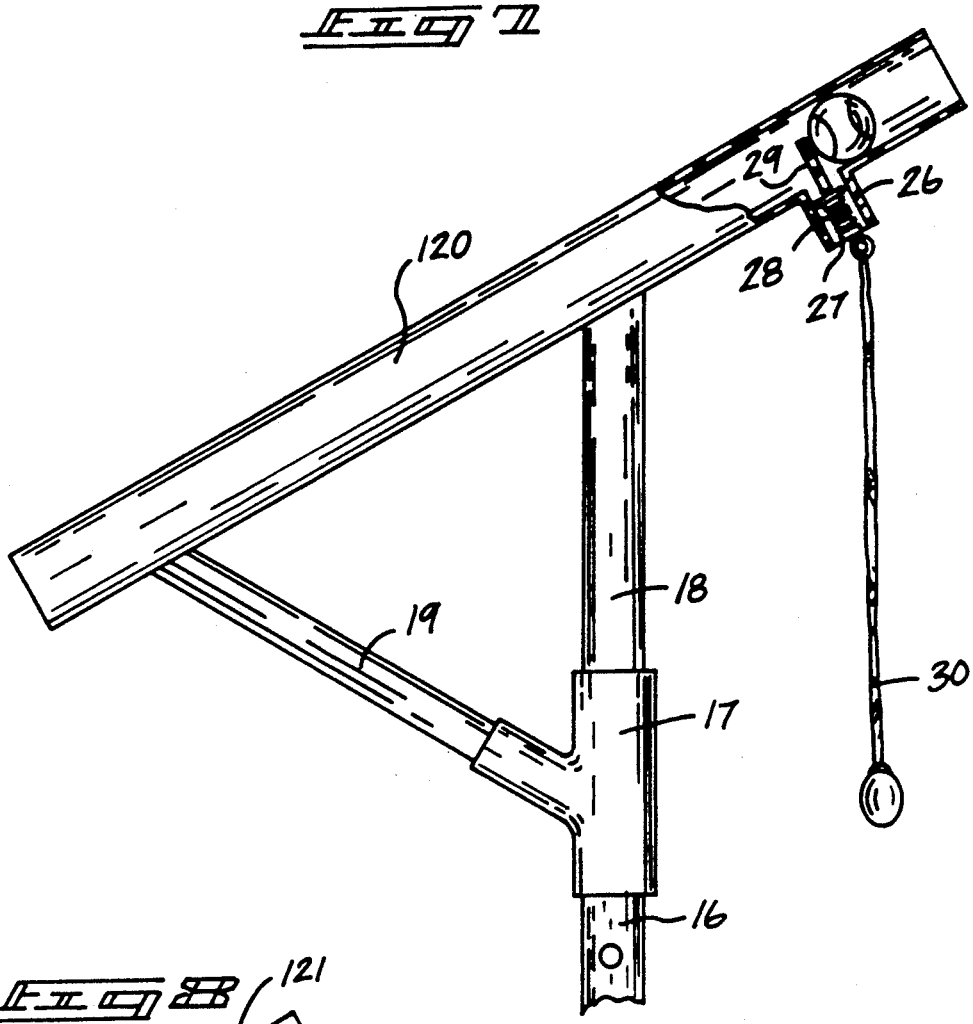
FIG. 7 is an orthographic view, partially in section, of the instant invention, utilizing a detent mechanism at an upper end thereof.
Figure 8:
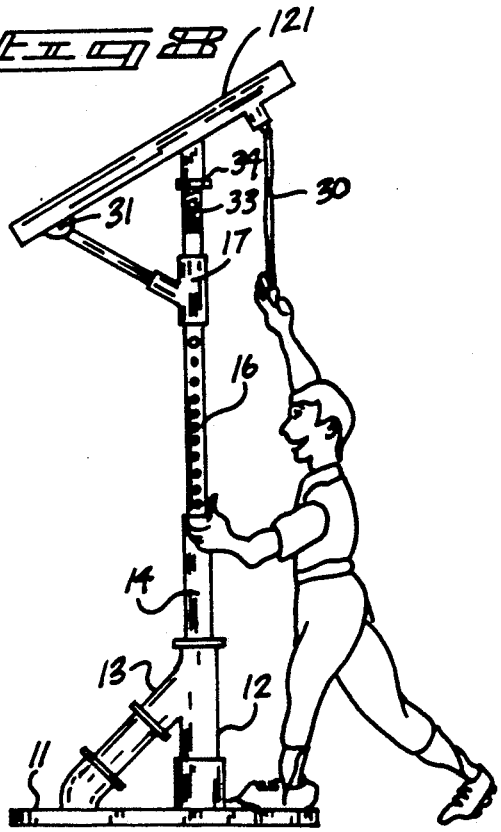
FIG. 8 is an orthographic side view, taken in elevation, of the instant invention utilizing the detent mechanism in association with a pivot structure to pivot the delivery tube of the instant invention.
Figure 9:
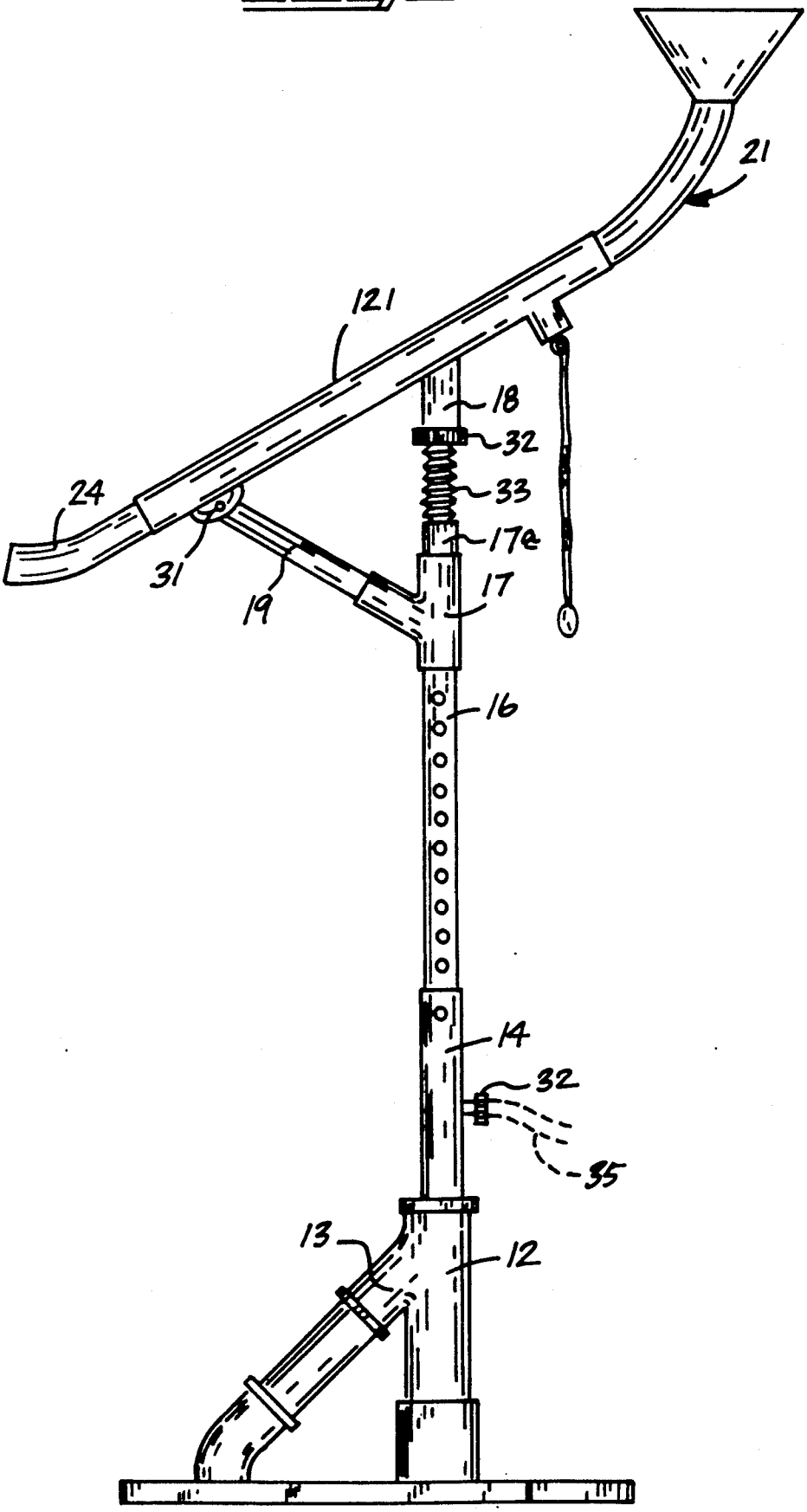
FIG. 9 is an orthographic side view, taken in elevation, of the instant invention in a complete assemblage

FIG. 7 illustrates the use of a modified delivery tube 120, including a hollow support boss 26 mounted within the modified delivery tube 120 adjacent an upper terminal end thereof, wherein a hollow support boss 26 includes a spring plate 27 formed at a lower terminal end thereof, with a spring member 28 mounted thereon. An abutment pin 29 is directed through the spring plate 27 and the spring member 28 coaxially thereof and projects within the central conduit of the modified delivery tube 120. A pull cord 30 permits retraction of the abutment pin 29 within the support boss 26 to permit the associated baseball "B" to be delivered through the delivery tube 120. FIG. 8 illustrates the use of a pivot pin 31 mounting an upper terminal end of the second upper leg 19 to the delivery tube, with a thumb screw 34 rotatably adjusting a screw thread 33 within an internally threaded joint member extension **17*a* mounted above the joint member 17 in vertical alignment with the first upper leg 18 to permit angular adjustment and orientation of the modified delivery tube 120. Further, as illustrated in FIG. 9, a water valve connection 32 permits mounting of a hose member 35 thereto to permit filling of the first and second platform legs 12 and 13** with water or other suitable fluid to enhance and add weight to the lower end of the platform to improve its stability during use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A batting practice apparatus comprising, in combination, a horizontally disposed support platform, the support platform including a hollow first platform leg having first and second ends, said first leg extending perpendicular from said support platform and having said first end attached thereto, a second platform leg having first and second ends, said first end of said second by being attached to said second end of the first platform leg and said second platform leg having its second end attached to the upper surface of said support platform at a spaced distance from said first end of said first leg such that an acute angle is formed between said first and second legs, a vertically extending positioning tube longitudinally aligned in said first platform leg; said positioning tube having a transverse aperture adjacent its upper end; a vertically extending adjusting tube having its lower and longitudinally telescoping into said positioning tube, said adjusting tube having a plurality of vertically aligned transverse apertures extending therethrough, each of said plurality of apertures being alignable with said positioning tube aperture for receiving a pin for locking said adjusting tube relative to said positioning tube, said adjusting tube having a joint member mounted to its upper end;

a first upper leg longitudinally aligned with said adjusting tube attached to said joint member, and a second upper leg attached to said joint member to define an acute angle between the first upper leg and the second upper leg, and an inclined ball delivery tube attached to said first upper leg and said second upper leg to define a triangle between said delivery tube, said first upper leg, and the second leg.

2. An apparatus as set forth in claim 1 wherein said delivery tube has an upper end and a lower end, said upper end having an arcuate shaped upwardly inclined tube mounted therein, said arcuate shaped tube having a funnel shaped member attached to its upper end.

3. An apparatus as set forth in claim 2 including a lower arcuate shaped tube having one of its end attached to said delivery tube lower end and its other end inclined upwards.

4. An apparatus as set forth in claim 3, wherein a hollow boss is attached to and adjacent said delivery tube upper end, said boss having an elongated spring biased abutment pin therein, said pin extending substantially perpendicular to the longitudinal axis of said delivery tube and having one of its ends extending into said delivery tube for stopping movement of a ball passing interiorly along said delivery tube; a pull cord attached to the other end of the abutment pin to effect retraction of said abutment pin relative to said delivery tube and to permit release of a ball for passing through said delivery tube between said abutment pin and said delivery tube lower end.

5. An apparatus as set forth in claim 4 wherein said first upper leg is hollow and has a threaded shaft longitudinally on its lower end, the other end of said shaft being threadably attached to said joint member, said shaft having a thumb screen intermediate its ends for adjusting said upper leg relative to said joint member said second upper leg being pivotally attached to said delivery tube to permit angular adjustment of said delivery tube relative to the support platform upon rotation of said thumb screw.

6. An apparatus as set forth in claim 5 wherein said first platform leg and said second platform leg are hollow and a water valve connection is in fluid communication with said first and second platform legs to permit filling of said first and second platform legs with fluid to enhance stability of said apparatus when in use.

* * * * *